US006033726A

United States Patent [19]

Innes

[11] Patent Number: 6,033,726

[45] Date of Patent: Mar. 7, 2000

[54] COATING OF WAX-LIKE MATERIALS ONTO MOVING STRIP ARTICLES

[75] Inventor: Robert Arthur Innes, Kingston, Canada

[73] Assignee: Alcan International Limited, Montreal, Canada

[21] Appl. No.: 08/836,649

[22] PCT Filed: Nov. 23, 1995

[86] PCT No.: PCT/CA95/00658

§ 371 Date: Jul. 14, 1997

§ 102(e) Date: Jul. 14, 1997

[87] PCT Pub. No.: WO96/15857

PCT Pub. Date: May 30, 1996

Related U.S. Application Data

[63] Continuation-in-part of application No. 08/344,564, Nov. 23, 1994, abandoned, which is a continuation-in-part of application No. 08/068,990, May 27, 1993, abandoned.

[51] Int. Cl.[7] ..... B05D 1/34; B05D 3/12

[52] U.S. Cl. ..... 427/209; 427/356; 427/358; 118/410

[58] Field of Search ..... 427/356, 358, 427/209; 118/410

[56] References Cited

U.S. PATENT DOCUMENTS 3,690,297 9/1972 Dentch et al. .
4,388,349 6/1983 Korpman et al. .
4,675,230 6/1987 Innes .

FOREIGN PATENT DOCUMENTS 0 067 060 A1 12/1982 European Pat. Off. .
0291598 11/1988 European Pat. Off. .
2260395 9/1975 France .
2473361 7/1981 France .

*Primary Examiner*—Katherine A. Bareford
*Attorney, Agent, or Firm*—Cooper & Dunham LLP

[57] ABSTRACT

A process of coating a heat-conductive strip article, e.g. aluminum or aluminum alloy strip used in the automotive industry, with a solid wax-like coating material, preferably a wax-type lubricant. The process involves heating a solid wax-like coating material that melts in a temperature range of about 30 to 100° C. to form a melt having a viscosity in a range of about 50 centipoise or less and flowing the melt onto a moving surface of the strip article through an elongated slot in a movable coating head having an extended surface adjacent to the slot to form a coating layer on the article. The coating head is pushed towards the surface of the strip article as the melt is flowed as a coating onto the surface from the slot to reduce a coating thickness by pressing the extended surface of the coating head onto the coating as the coating is formed. The process allows a coating of a wax-like material to be formed to a desired thickness and yet allows the wax-like material to solidify shortly after application to the strip article so that the strip can be coiled without providing a cooling run of undue length or a special cooling devices.

13 Claims, 3 Drawing Sheets

COATING OF WAX-LIKE MATERIALS ONTO MOVING STRIP ARTICLES

This is a continuation-in-part based on U.S. Ser. No. 08/344,564, filed Nov. 23, 1994, now abandoned, which is a continuation-in-part of U.S. Ser. No. 08/068,990, filed May 27, 1993, now abandoned.

This application is a national stage application of PCT/CA96/00658, filed Nov. 11, 1995.

TECHNICAL FIELD

This is a continuation-in-part on U.S. Ser. No. 08,344,564, filed Nov. 23, 1994, now abandoned, which is a continuation-in-part of co-pending U.S. Ser. No. 08/068,990, filed May 27, 1993, now abandoned.

This invention relates to the coating of strip articles with wax-like materials. More particularly, the invention relates to a coating procedure that is particularly suited for coating aluminum and aluminum alloy strips, such as those used for automotive sheet stock, with wax-type lubricants.

BACKGROUND ART

The use of aluminum and aluminum alloys in the manufacture of vehicle bodies and other automotive parts is of increasing interest nowadays as manufactures and regulators strive to reduce fuel consumption and air pollution. This has lead to the use of adhesives for bonding aluminum parts since welding of aluminum is problematic and inefficient. However, conventional lubricants used for coating sheet surfaces during sheet manufacture tend not to be compatible with the adhesives suitable for the bonding process and new lubricants have been developed to overcome this problem. These new lubricants usually have the properties of waxes, i.e. they are solid at room temperature but melt to low viscosity liquids (e.g. liquids of viscosity less than 50 centipoise, and often less than 30 centipoise) at slightly higher temperatures (e.g. 30 to 100° C., or more commonly 30–50° C., depending on the identity and formulation of the lubricant).

At present, a heated roller coater is normally used to apply such lubricants, but inefficiencies are encountered because the distribution of the coating material across the strip surface becomes variable due to the tendency of the low viscosity lubricant to flow in irregular patterns over the metal surface following its initial application.

Moreover, sufficient heat is transferred to the metal sheet by the coater during the coating process that solidification of the lubricant is delayed. Unless. special precautions are taken, e.g. the installation of a separate cooling zone downstream of the coater apparatus, the lubricant may still be in a molten state when the sheet reaches the coiler apparatus provided for coiling the strip article after coating. If the lubricant is still molten while the strip is being coiled, the coiling pressure exerted on the strip surface will cause unacceptable thinning of the lubricant film, with excess material being forced out through the sides of the coil. Additionally, the very low strip surface friction can cause the coil to become unstable and to "telescope" during the coiling operation.

There is accordingly a need for an improved method of coating metal sheet with wax-like materials of this kind.

DISCLOSURE OF THE INVENTION

An object of the invention is to enable metal sheet articles to be coated with wax-like coating materials, particularly lubricants, in an efficient manner.

Another object of the invention is to enable wax-like coating materials, particularly lubricants, to be coated in relatively thick layers onto sheet articles.

Yet another object of the invention is to make it possible to avoid forced cooling of a strip article after coating with a wax-like coating materials, particularly lubricant, prior to coiling without substantial risk of disrupting the coating layer and of destabilizing the shape of the coil as it is being formed, during coiling.

According to the present invention, there is provided a process of forming a coating layer of a solid wax-like coating material on a surface of a heat-conductive strip article, in which the solid wax-like coating material is heated to form a melt, and a coating layer is formed on an advancing surface of the strip article by applying the melt onto the surface and cooling the melt to form a solid coating layer, characterized in that the melt is flowed onto the advancing surface from an elongated, open-sided slot of a movable coating head provided with an extended surface adjacent to the slot orientated at an angle to the strip article to define a coating gap converging in the direction of advancement of the strip article, and pushing the coating head towards the surface of the strip article, against opposing hydrodynamic forces exerted by said coating material on said extended surface in said gap, as said melt is flowed onto the surface from the slot, to control the coating layer thickness.

The present invention is based on the unexpected finding that wax-like coating materials, and particularly wax-like lubricants used in the automotive and related industries, can be applied by means of a coating apparatus provided with a "floating" coating head having an elongated open-sided coating slot. The success of this procedure is surprising because coating apparatus of this kind, while known for other applications, has not been considered suitable for coating low viscosity liquids since undue leakage of such liquids takes place and uniform coating layers are not formed. Furthermore, fluids of low viscosity do not usually generate sufficient hydrodynamic force to prevent the coating head from undergoing metal-metal contact with the moving strip surface. However, in the process of the present invention, it seems that partial solidification of the wax-like coating material takes place in the coating gap in a sufficiently reliable manner such that effective coating can be achieved despite the initial low viscosity of the coating material.

Another consideration is that, since unacceptably long solidification times are required in conventional coating apparatus used for producing wax-like coatings, it was to be expected that similar problems would be encountered if slot-type coaters were employed for this purpose. However, it has surprisingly turned cut that "floating head" type apparatus allows coatings to be formed that solidify quickly, perhaps because the hot coating head does not directly contact the strip article, and thus does not result in undue heating of the strip.

A preferred example of the type of apparatus used for the process of the present invention suitable for single-sided coating of a strip article is disclosed in U.S. Pat. No. 4,675,230 of Jun. 23, 1987, assigned to the same assignee as the present application. Moreover, a related apparatus for two-sided coating of sheet material is disclosed in pending PCT Patent Application Ser. No. PCT/CA94/0029, filed May 26, 1994 and published on Dec. 8, 1994 as WO 94/27739, and assigned to the same assignee as the present application.

The process of the present invention is effective for coating any strip article made of a material of sufficiently good thermal conductivity that heat from the wax-like coating can be rapidly dispersed and the liquid coating thereby rapidly solidified. While the minimum thermal conductivity that will achieve this result varies according to a number of factors (e.g. the characteristics and temperature of the coating material, the speed of advance of the strip article, etc.), common metals, and particularly aluminum and aluminum alloys, are suitable for coating according to the process of the present invention.

Numerous "wax-like coating materials" are suitable for use in the present invention, but wax-type lubricants are particularly preferred. These materials, while being solid at room or ambient temperature, form liquids having low viscosities, generally of less than 50 centipoise, and more commonly less than 30 centipoise, when heated to temperatures in the range of 30–100° C., or more usually 30–50° C. Waxy materials containing olefin, e.g. alcohol esters of fatty acids or fatty diamides, are especially suited for use in the present invention, and particular examples of suitable wax-type lubricants include the following: glycerol monolaurate, pentaerythritol monostearate, ethylene glycol monolaurate, glycerol monopalmitate, ethylene glycol monostearate, glycerol dipalmitate and propylene glycol distearate.

Since rapid cooling and solidification of the coating material during and immediately following coating is necessary in the present invention, it is preferable prior to coating to heat the wax-like coating material only to the lowest temperature possible without risking premature freezing of the material in the coating apparatus. Temperatures of 30–100° C. and more preferably 30–50° C., are generally suitable.

As noted above, the coating layer must be solid before the strip article can be coiled, so the strip should preferably be advanced at a speed that permits solidification to take place before the coating reaches the coiling apparatus and, for a given strip article and coating material, this will vary according to the distance between the coating apparatus and the coiling apparatus. Clearly, the best productivity will be achieved by advancing the strip at or close to the maximum speed that permits complete solidification in advance of the coiling apparatus, but lower speeds of advance may be employed, if desired, provided an even, smooth coating layer can still be produced. The minimum speed at which suitable coating is still possible depends on such factors as the size of the coating gap, the nature of the strip article and the identity of the coating material. Suitable speeds can be determined by simple trial and experiment.

The strip article itself should preferably be relatively cool when the coating is applied to ensure rapid solidification of the coating. However, pre-cooling of the strip article is generally not required since strip at ambient temperature is usually suitable.

By applying the wax-like coating material in the manner indicated in the present invention, rapid and effective coating of wax-like coating materials, and particularly wax-type lubricants, can be achieved without the disadvantages encountered when using conventional apparatus.

BEST MODES FOR CARRYING OUT THE INVENTION

Figure 1:
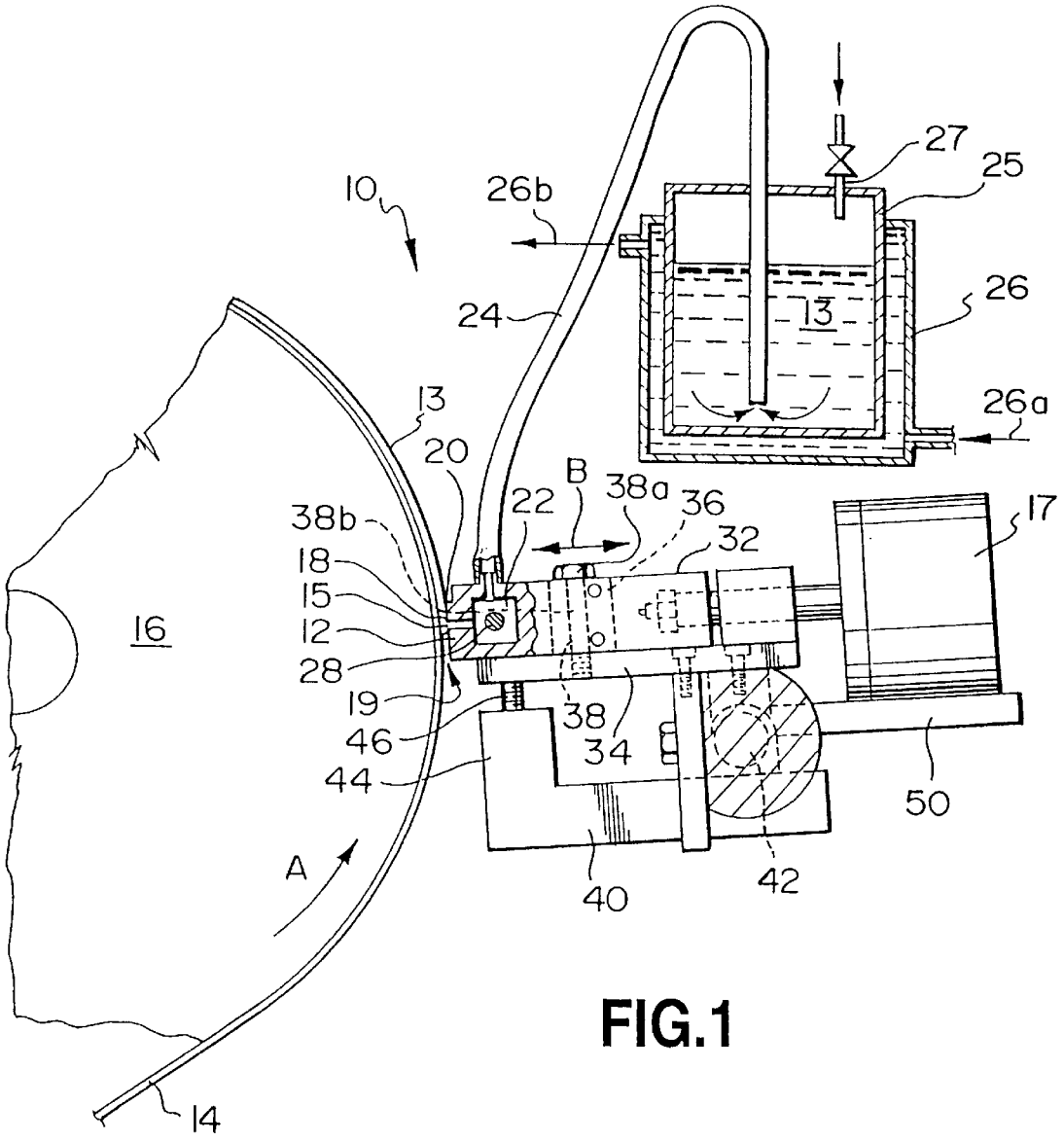
FIG. 1 is a side elevation, partly in cross-section, of a coating apparatus suitable for carrying out a preferred embodiment of the present invention.

Apparatus suitable for carrying out one preferred embodiment of the present invention is shown in simplified form in FIG. 1. The apparatus 10 consists of a coating head 12 of the type described in U.S. Pat. No. 4,675,230, but modified in the manner described below, that applies a layer of wax type lubricant 13 onto an aluminum strip 14 passed around an unheated backup drum 16 in the direction of arrow A. The coating head 12, having a generally open-sided co-extensive longitudinal coating slot 15, extends over the entire width of the strip at a position, in the path of the strip advance, at which the strip is held firmly against the surface of the backup drum 16. The end of the coating head 12 facing the strip 14 has an extended coating surface 18, adjacent to the outer opening of the slot 15 at least on the downstream side of the slot, provided with a downstream edge 20. The extended surface 18 is arranged at an angle (normally in the range of 0.1 to 5°, or more preferably 0.5 to 1°) to the surface of the strip 14 to form a coating gap 19 that narrows in the direction of strip advance.

The coating head 12 has an interior channel 22 communicating with the coating slot 15. This channel is fed with molten wax-like coating material by a heated pressure hose 24 communicating with a pressurized reservoir 25. The reservoir contains coating material 13 that is kept molten by heat input from a surrounding hot water jacket 26, through which hot water is constantly passed via inlet 26*a* and outlet 26*b*. The reservoir is pressurized by compressed air introduced through inlet 27 at the upper part of the reservoir. The internal channel 22 in the coating head contains an elongated rod-like electrical heater 28 used to prevent freezing of the coating material within the coating head. The pressure applied to the coating material within the reservoir 25 is sufficient to express the molten coating material from the slot 15 onto the surface of the strip 14 where the extended surface 18 of the coating head adjacent to the slot spreads the coating material and meters its thickness.

The coating head 12 forms part of, or is attached to, a metal block 32 supported on a deck 34 having a flat upper surface on which the metal block 32 rests, the block being thus supported for sliding movement relative to the deck in a generally horizontal direction, as shown by double headed arrow B. A number of vertically opening slots 36 (only one of which is shown in FIG. 1), elongated horizontally in the direction of arrow B, are formed in the body of the block 32 rearwardly of the channel 22 at locations spaced along the length of the block. A number of bolts 38 (only one of which is shown) respectively extend through these slots and are threaded in the deck at one end while having enlarged bolt heads 38*a* at the other end to retain the block 32 on the deck 34. Interference between bolt shanks 38*b* and the side walls of the slots 36 prevents lateral movement of the block 32 relative to the deck, but the elongation of the slots permits the block 32 to move in the direction of arrow B through the full range of operative head positions.

The deck 34 is mounted on a feed frame 40 for pivotal movement about a horizontal axis 42, so as to enable the block 32, with the deck, to be swung upwardly (e.g. by suitable pneumatic means, not shown) from the position illustrated in FIG. 1 to a position removed from the path of strip advance. An arm 44, fixedly secured to the frame 40 and underlying the deck 34, carries a screw 46 that projects upwardly from the arm and bears against the lower surface of the deck 34, to enable adjustment of the angular orientation of the head 12 in its operative position.

The frame 40 is fixed in position relative to the axis of the drum 16, both the frame and the roll being mounted in a common support structure (not shown). Thus, the axis 42 is fixed in position relative to the axis of the drum 16 and when the deck 34 is in the operative position shown in FIG. 2, with the screw 46 set to provide a desired angular orientation, the drum 16 supports the advancing strip 14, opposite the slot 15, at a fixed distance from the deck 34.

The apparatus further includes means acting between the deck 34 and the head 12 for continuously exerting a load on the head to urge the head toward the facing surface of the strip 14. This load-exerting means comprises a number of air cylinders 17 (only one of which is shown and which may be of generally conventional construction) fixed securely to the deck 34 rearwardly of the block 32. As shown, the cylinders 17 are secured to the rearwardly projecting ledge portions 50 of the deck. Actuation of the cylinders (which may be of a generally conventional character) causes the block 32 and coating head 12 to be pushed towards the surface of the strip 14. This load is opposed by the fluid pressure (hydrodynamic force) of the molten (or partially solidifying) coating material 13 acting on the extended surface 18 so that the head 12 "floats " on the material layer 13. Thereby, a metering orifice is defined between the downstream edge 20 of the surface 18 and the strip surface, the size of the metering orifice being determined (for a given coating material) by the magnitude of the load exerted by the cylinders, which is generally 0.18–27 kg/cm (1–150 lbs./linear inch) of strip width and more preferably 0.9–9 kg/cm (5–50 lbs./linear inch). No direct mechanical contact takes place between the coating head 12 and the strip 14, so heat transfer to and defacement of the surface of the strip is avoided.

Surprisingly, it has been found that the wax-like coating material, although of low viscosity normally in the range of less than 50 centipoise. e.g. 20 to 30 centipoise, can be successfully coated onto the metal strip using the indicated type of apparatus in which the coating thickness is controlled by a dynamic load control mechanism. In principle, while this type of coating apparatus can be used to apply any liquid to a strip article, in practice the equipment is not effective for liquids of low viscosity. The coating gap 19 between the extruder head and the strip article for a particular coating material is selected according to viscosity, speed and the required coating thickness to ensure that the generated forces are in a practical range for control. For very low viscosity liquids, low speeds and thick coating layers, the required gap width becomes too wide to be practical. However, we have surprisingly found that the equipment is suitable for applying low viscosity molten wax-like materials. It is theorized that, because no part of the heated extruder head 12 directly touches the strip article 14, the strip article does not become unduly heated above ambient temperature before it receives the layer of molten wax-like material and, because of the high thermal conductivity of the metal sheet article (particularly when it is made of aluminum or aluminum alloy) and the relative thinness of the layer of coating material, the coating material commences to freeze immediately it contacts the strip article within the coating gap between the article surface and the coating head. This increases the effective viscosity of the coating sufficiently to make the coating equipment effective and to allow relatively thick layers of the low viscosity lubricant (e.g. thicknesses with the range of 1–100 microns, and more preferably 2–25 microns) to be applied at relatively low coating speeds (e.g. about 15 m/min (50 ft/min)). In practice the lubricant is usually found to be completely solid within a few feet of the coating head.

By heating each of the reservoir 25, the pressure hose 24 and the coating head 12 (by heater 28), the coating material 13 can be kept in molten condition within the viscosity range indicated above until applied as a coating to the strip 14.

Beyond the drum 16, the strip can cool the molten wax-like material rapidly below its freezing point since it has not been unduly heated by the coating procedure so the strip can be coiled in the conventional manner without the need for a separate cooling step.

Although the illustrated apparatus is designed for single-sided coating, the invention may also be utilized for two-sided coating using apparatus of the type disclosed in the application mentioned above, modified to be fed with molten wax-like coating material as in the apparatus described for single-sided coating.

Figure 2:
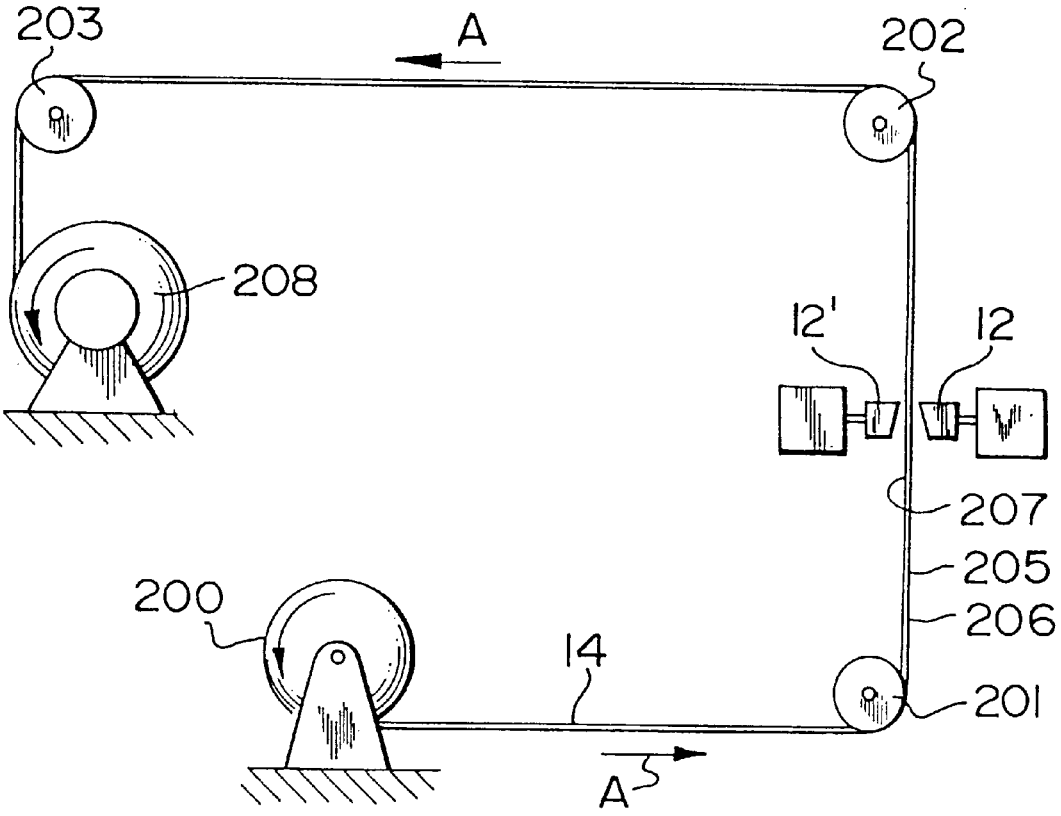
FIG. 2 is a greatly simplified schematic representation of apparatus for carrying out two-sided coating according to another preferred embodiment of the invention.

An example of an apparatus suitable for double-sided coating is shown in FIG. 2. Metal strip 14 to be coated is continuously advanced, in a direction longitudinally parallel to its long dimension, from a coil 200 along a path represented by arrows A extending successively around spaced guide rollers 201, 202, 203 rotatably supported (by structure not shown) in axially fixed positions. The rollers 201 and 202 cooperatively define a rectilinear portion 205 of the path, in which portion the major surfaces of the advancing strip are substantially planar. At a locality in this path portion 205, coating material is applied to both major surfaces 206 and 207 of the strip 14 from two coating heads 12, 12' (disposed in register with each other and respectively facing the two major surfaces of the strip article) to establish on each of the strip surfaces a continuous layer or coating of the wax-like material. After passing roll 203, the coated strip is coiled again, e.g. on a driven rewind reel 208 which constitutes the means for advancing the strip through the coating line.

The coating devices 12 and 12' may each be the same as the coating head 12 described for the previous embodiment fed with coating material and pushed towards the strip surfaces in the same way.

In this embodiment, molten coating material is applied simultaneously to both sides of the strip at about the same point, but nevertheless freezing of the applied coating takes place within the coating gaps and thick layers of lubricant can be applied to both sides of the strip 14.

As a final point, it should be pointed out that the process of the invention is not limited to the coating of wax-type lubricants onto automotive strip stock, but may be used for similar applications in which a wax-like material is coated onto a strip article, e.a. the coating of aluminum can end stock with protective layers.

The invention is illustrated further by the following Examples, which are not intended to limit the scope of the invention.

EXAMPLE 1

Figure 3:
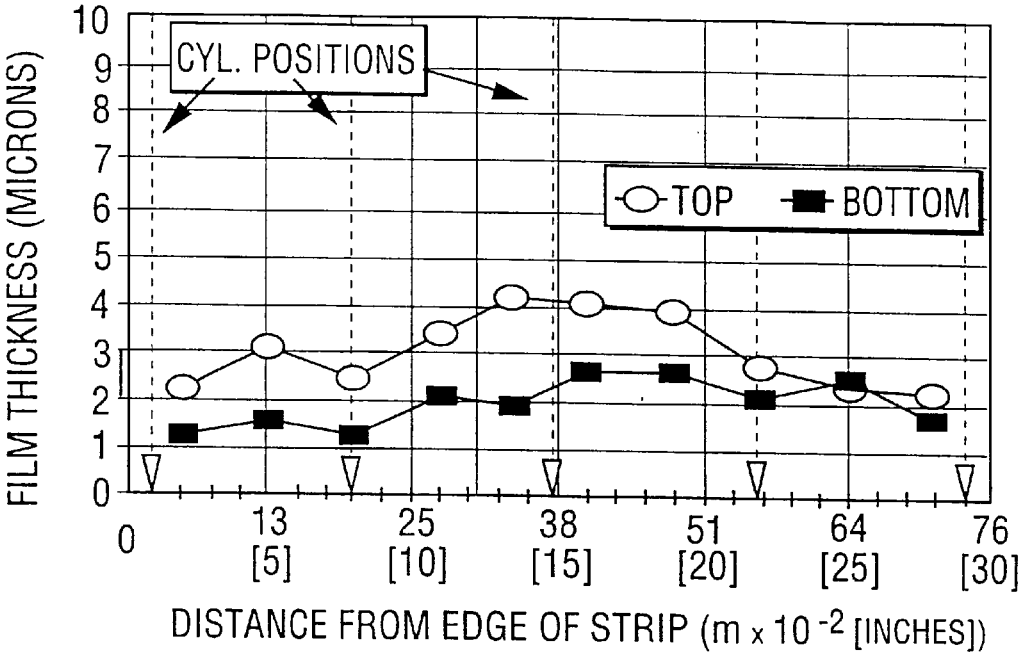
FIG. 3 is a graph showing test results obtained in the manner explained in the Example 1.

Tests were carried out on 0.09 cm (0.036 inch) gauge autosheet (aluminum alloy) using a thirty inch two side coating apparatus of the type illustrated herein (provided with five load application cylinders 17) using AL070 wax-type lubricant (ethylene glycol monolaurate having a melting point of about 35 to 37° C.) applied at a temperature of 44° C. The coating material was supplied to the coating heads at a pressure of 34.5 kPa (5 pounds per square inch) and the coating heads were pushed towards the strip surface at an average force of 6.25 kg/cm (35 pounds per lineal inch) of scrip width. The test results are illustrated in the graph of FIG. 3 showing coating thickness distribution on the top and bottom surfaces of the sheet (when the sheet is advanced horizontally from the apparatus) across the width of the sheet. The vertical arrows in the graph show the positions of five loading air cylinders, which were set respectively at pressures of 0, 138, 138, 138 and 0 kPa (0, 20, 20, 20 and 0 pounds per square inch) of air pressure. The speed of strip movement was 15 m/min (50 ft./min), the metering land width was 0.8 cm (0.3 inches) and the angle of the coating head was 0.5 degrees. Under these conditions, the film weight calculated theoretically for a coating liquid having a viscosity of 30 centipoise is about 0.1 gram/square meter. The fact that the actual thickness of the coating ranged from 1 to 3.5 gram/square meter shows that the invention is capable of producing films of greater than theoretical thickness. The coatings thereby produced are believed to be of acceptable thickness and uniformity for use in automative applications.

EXAMPLE 2

Figure 4:
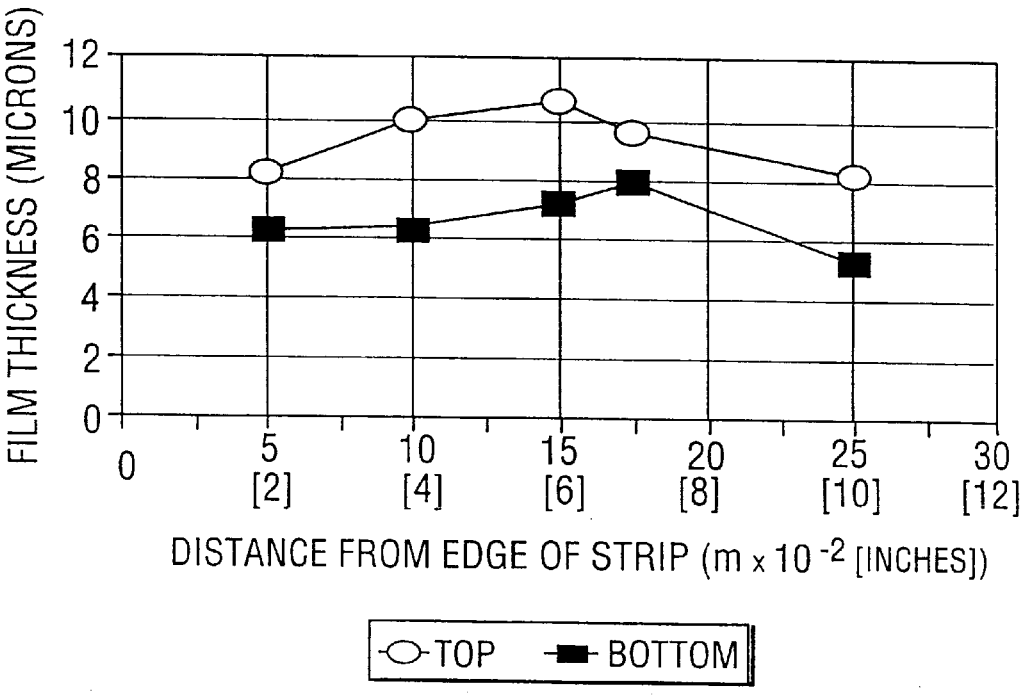
FIG. 4 is a graph showing test results obtained in the manner explained in Example 2.

Strip coating was carried out on 0.03 cm (0.011 inch) gauge aluminum can stock using a two sided coating apparatus having a coating head 30 cm (12 inches) in width (the coating width being 29 cm (11.5 inches)). Again waxy lubricant AL070 was used, but this time at an application temperature of 51° C. Two load application cylinders were provided per coating head, one at each end, having a cylinder inside diameter of 3.8 cm (1.5 inch), and each was pressurized with air to a pressure of 310 kPa (45 pounds per square inch). The average load on each coating head resulting from the cylinders was 2.5 kg/lineal cm (13.9 pounds/lineal inch) of strip width. Each coating head had a land width of 0.63 cm (0.25 inches) was set at an angle of 0.5 degrees to the strip surface. The coating material was supplied to each coating head at 24 kPa (3.5 pounds/sq. inch pressure) and the strip was advanced at 15 m per minute (50 feet per minute). The results are shown in the graph of FIG. 4. The coatings thereby produced are believed to be of acceptable thickness and uniformity for use in automotive applications. The coatings thereby produced are believed to be of acceptable thickness and uniformity for use in automotive applications.

I claim:

1. A process of forming a coating layer of coating material on a surface of heat-conductive strip article, in which the coating material is flowed onto an advancing surface of the article from an elongated, open-sided slot of a movable coating head provided with an extended surface adjacent to the slot orientated at an angle to the strip article to define a coating gap converging in the direction of advancement of the strip article, and pushing the coating head towards the surface of the strip article against opposing hydrodynamic forces exerted by said coating material on said extended surface in said gap, as the coating material is flowed onto the surface from the slot, to control the coating layer thickness, characterized in that a solid wax type lubricant coating material is heated to form a melt having a viscosity of 50 centipoise or less, and said melt is fed to said open-sided slot as said coating material.

2. A process according to claim 1 characterized by using aluminum or aluminum alloy strip as said heat-conductive strip article.

3. A process according to claim 1 characterized in that said solid wax type lubricant coating material is a material that melts in a temperature range of 30–50° C. to form a melt having a viscosity of 30 centipoise or less, and in that said solid wax type lubricant coating material is heated to a temperature within said range.

4. A process according to claim 1 wherein said strip article has a second surface and a layer of coating material is also formed simultaneously on said second surface of said strip article by flowing a coating material onto said second surface from an elongated open-sided slot provided in a second movable coating head having an extended surface adjacent to the slot orientated at an angle to the strip article to define a coating gap converging in the direction of advancement of the strip article, and pushing the second coating head towards the second surface of the strip article, against hydrodynamic forces exerted by said coating material on said extended surface of said second coating head in said gap, as said coating surface is flowed onto the second surface from the slot, to control said second coating layer thickness, characterized in that a solid wax type lubricant coating material is heated to form a melt having a viscosity of 50 centipoise or less, and said melt is fed to said open-sided slot of said second coating head as said coating material.

5. A process according to claim 1 characterized in that said coating head is pushed towards said surface with a force that produces a coating thickness in the range of 1–100 microns.

6. A process according to claim 1 characterized in that said coating head is pushed towards said surface with a force that produces a coating thickness in the range of 2–25 microns.

7. A process to claim 1 characterized in that said coating head is pushed towards said surface with a force in the range of 0.18–27 Kg/linear cm of width of the strip.

8. A process according to claim 1 characterized in that said coating head is pushed towards said surface with a force in the range of 0.9–9 Kg/linear cm of width of the strip.

9. A process according to claim 1 characterized in that said melt is maintained at a temperature less than about 100° C. before being applied to said strip article.

10. A process according to claim 1 characterized in that said melt is maintained at a temperature less than about 50° C. before being applied to said strip article.

11. A process according to claim 1 characterized in that said strip article is maintained at ambient temperature before said melt is applied.

12. A process according to claim 1 characterized by employing a lubricant selected from glycerol monolaurate, pentaerythritol monstearate, ethylene glycol monolaurate, glycerol monopalmitate, ethylene glycol monostearate, glycerol dipalmitate and propylene glycol distearate.

13. A process according to claim 1 characterized in that said coating hard is heated to avoid solidification of said melt before application to said surface.

* * * * *